United States Patent [19]

Migliaccio et al.

[11] 4,043,303

[45] Aug. 23, 1977

[54] AIR-FUEL RATIO CONTROL SYSTEM FOR INTERNAL-COMBUSTION ENGINES WITH CONTROLLED IGNITION

[75] Inventors: Mariano Migliaccio; Emilio Pisani, both of Napoli, Italy

[73] Assignee: Consiglio Nazionale Delle Ricerche, Italy

[21] Appl. No.: 588,811

[22] Filed: June 20, 1975

[30] Foreign Application Priority Data

June 24, 1974 Italy ..... 51712/74

[51] Int. Cl.[2] ..... F02M 7/00; F02M 13/00

[52] U.S. Cl. ..... 123/119 R; 123/97 B; 123/DIG. 10; 261/36 R; 261/41 R; 261/DIG. 69

[58] Field of Search ..... 123/119 R, DIG. 10, 123/97 B; 261/DIG. 69, 36 A, 36 R, 41 R

[56] References Cited

U.S. PATENT DOCUMENTS

| | | | |
|---|---|---|---|
| 3,574,346 | 4/1971 | Sulich | 261/36 R |
| 3,598,096 | 8/1971 | Timpner | 123/119 R |
| 3,669,423 | 6/1972 | Hohsho | 123/119 R |
| 3,690,625 | 9/1972 | Ishida | 261/36 A |
| 3,827,415 | 8/1974 | Makino | 123/119 R |

*Primary Examiner*—Wendell E. Burns
*Attorney, Agent, or Firm*—McGlew and Tuttle

[57] ABSTRACT

An air-fuel ratio control system for internal-combustion engines with controlled ignition and fed by a liquid fuel, supplied through a main pump and which during the operation is at least partially deviated into a re-cycle circuit and which, as the throttle valve controlling the intake pipe at least partially opens, is injected into said intake pipe to be mixed with the carburation air, wherein from the main pipe supplying the fuel three pipes are branched off, all ending into the inner chamber of a fluidistor, one of which supplying fuel at a constant delivery rate, the second pipe conveying fuel at a constant but adjustable delivery rate, and the third pipe conveying fuel at a variable delivery rate controlled by a pressure sensitive diaphragm valve in response to the resultant value of the subatmospheric pressure into the intake pipe sensed on the upstream and on the downstream side of the throttle valve, the fluidistor having two outlet pipes, the first of which is connected to a re-cycle reservoir and from the second pipe two pipes are branched off, the first of which ending with a fuel injection nozzle positioned on the upstream side of the throttle valve and the second being connected to a gauged injection nozzle for supplying the fuel required for the slow running, said pipes being each controlled by an electrovalve which normally is opened, but is shut under the control of a pressure transducer responsive to the vacuum degree in the inside of the fuel intake manifold of the engine cylinder on the downstream side of the throttle valve and which is designed to operate only when the vacuum degree into said manifold is below a predetermined minimum value.

8 Claims, 5 Drawing Figures

AIR-FUEL RATIO CONTROL SYSTEM FOR INTERNAL-COMBUSTION ENGINES WITH CONTROLLED IGNITION

The present invention concerns a system for varying the air-fuel ratio in the internal-combustion engines with controlled ignition and fed by a liquid fuel, in particular, gasoline or petrol, said system including a fluidic linear device positioned on the downstream side of the main fuel supply pump, for controlling the fuel delivery rate, said device operating exclusively in liquid phase and enabling to vary said delivery rate in response to the different running conditions of the engine, and, in particular, in function of a sole parameter, i.e. the pressure variation in the carburetion chamber. This system may be also suited to operate, not only in response to said pressure parameter, but also in response to any variation of the revolution number of the engine driving shaft.

The system of this invention can be applied to internal-combustion engines with controlled ignition of every piston displacement and power with very few mechanical modifications.

When the system is designed to operate in response to the variation of a sole parameter, in particular in response to any pressure variation in the intake manifold, it comprises the linear fluidic control device which will be hereinafter named "fluidistor" and which consists of a chamber into which three jets of fuel are let to flow together which are supplied through three pipes branched off from the main fuel supply pipe on the downstream side of the main fuel supply pump and wherein the first of said jets has a constant delivery rate, the second jet is supplied through a pipe in which a gauged valve is arranged so that through said second pipe a constant gauged but controllable fuel stream is conveyed according to the different piston displacements of the engines to which the system will be applied, and the third jet is fed through a pipe in which a pressure responsive diaphragm valve is provided to increase or decrease the delivery rate of the fuel stema conveyed therethrough in response to every increase or decrease of the vacuum degree which corresponds to the average value between the vacuum degree on the up-stream and on the downstream side of the valve which controls the supply of the air-fuel mixture into the intake manifold of the engine, in particular, a throttle or butteryfly valve. The first of the two intake orifices through which is taken a signal, representative of the subatmospheric pressure of vacuum degree is arranged on the upstream side of the throttle valve and opens in the construction portion or throat of a Venturi tube arranged in the intake pipe, while the second intake orifice, arranged on downstream side of said throttle valve, is able to provide a stronger vacuum signal under engine load or unload conditions. In fact it is well known that in slow running condition of an engine of such a type, the first signal taken on the upstream side of the throttle valve is very weak, but it is directly proportional with regard to the intaken air stream into the engine cylinder. The second vacuum signal taken on the downstream side of said throttle valve is stronger in slow running condition and therefore it is used to make stronger and said signal which is used to control the pressure responsive diaphragm valve, said second signal taking a relationship with the air stream according to a different law; this allows to reduce the size of the pressure responsive diaphragm valve. The chamber of the fluidic device has two outlet orifices the first of which communicates with a first fuel recycle pipe and the second orifice communicates with a second pipe from which two pipes are branced off ending respectively the first with an injection nozzle arranged on the upstream side of the throttle valve and the other with a nozzle, for directly supplying the fuel in the intake pipe required for the slow running and arranged on the downstream side of said valve, said second pipe being controlled by a gauging valve.

The pipe for supplying the fuel during the normal running of the engine as well as that for the slow running condition are each controlled by an electro-valve; said electro-valves are normally opened, but they are shut by a vacuum transducer, which becomes operative as soon as a pre-determined value of the subatmospheric pressure on the downstream side of the throttle valve has been attained, afterwards all the fuel will be recycled through said fluidistor.

The invention further provides a variant, according to which means is provided to supply the fuel directly into the intake manifold on the downstream side of the throttle valve and which is automatically made operative during the acceleration phase under the control of a pressure transducer to which a fluid is fed by a pneumatic cylinder controlled by a vacuum signal taken on the downstream side of the throttle valve.

The invention further provides a variant of said pneumatic device according to which this latter is also used to co-operate in the control of the said pressure responsive diaphragm valve in order to vary the air-fuel ratio, in the event of a sudden opening of the valve and/or of a load variation of the engine so as to increase the delivery rate of the fuel stream flowing into the fluidistor chamber in such transition conditions of the engine.

The known carburetors are substantially of two types:

a. suction-type caburetors, the fuel delivery ratio of which is automatically controlled by the varying of the suction effect. The carburetors of this type are adjusted so as to operate in their best manner at a predetermined running condition so that they are not suited to well operate in all the other different running conditions unless auxiliary, delicate and complex control devices be provided. Furthermore during their operation a unavoidable mixing of the streams of air and fuel takes place with the formation of bubbles of air or of fuel gas within the pipes through which the fuel flows, that producing inevitable irregularities in their operation.

b. Injection carburetors. These carburetors are very sophisticated and expensive.

The carburetor of this invention is similar to those of this last type, with regard to its performance but it has a very simple, inexpensive structure and offers a considerable affidability. It permits to afford a wide regulation range and such a regulation can be performed also during the engine running.

It permits to obtain a ready response to the different work conditions of the engine and that is the result of the good response speed typical of the fluidic devices and it is due also to the fact that the fuel in the circuit has always a light pressure.

The accompanying drawings show, merely by way of example without limiting the invention, some embodiments of this latter; in these drawings.

Figure 1:
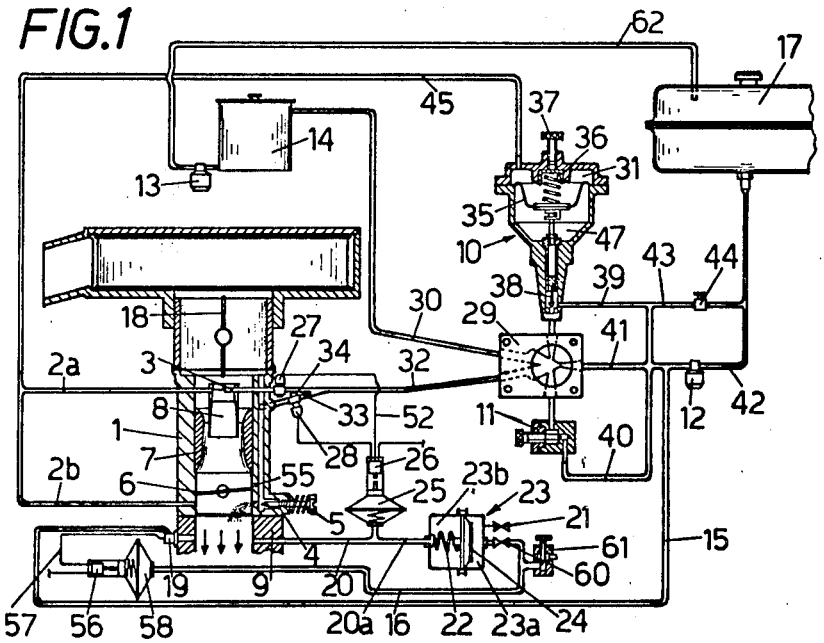
FIG. 1 is a diagrammatic view of the system according to a first embodiment of this invention.

Now referring to FIG. 1, 42 is the main pipe supplying the liquid fuel and which is connected to the main fuel reservoir 17, said fuel being supplied by an electro-pump 12; which pushes the fuel under a moderate pressure into the pipes 15, 39, 40 and 41, branced off from the pipe 42. The pump 12 is by-passed by a pipe 43 ito which is provided a pressure limiting device 44 designed to maintain constant at a predetermined value the pressure on the downstream side of said main pump 12. The delivery rate of the fuel conveyed into the pipe 39 is regulated by a gauging servo-valve 10 having a shaped needle 38 so that, by varying the position of said needle 38 the fuel stream will be regulated, said valve being a pressure responsive diaphragm valve acting in response to any pressure variation in the carburetion or intake pipe 1, as will be better hereinbelow described.

The delivery rate of the fuel conveyed into the pipe 40 is similarly controlled, by duly positioning the gauging needle of a needle valve 11 provided in the pipe 40, said valve 11 serving as an adjusting means during the tuning of the engine so as to suit this system to engines of different piston displacements.

The delivery rate of the fuel fed into the pipe 15 is constant.

The device 29 is a fluidic linear device designed to control the fuel delivery rate and which is able to act only on a liquid fuel, in particular, gasoline or petrol and into which is arranged a chamber where three fuel jets flow together, i.e., a main jet having a constant delivery rate and coming out of the pipe 41, and two control jets, the first of which is conveyed through the pipe 39 and its delivery rate is varied in response of the pressure within the carburetion pipe 1 on the upstream and downstream sides of the throttle valve 6, and the second one has a constant by adjustable delivery rate and is conveyed through the pipe 40 and the gauging valve 11. The quantity of fuel supplied into the fluidistor 29 will be thus the resultant of the main jet and of two control jets so that the delivery rate of the fuel issued from the fluidistor 29 (said outflow stream being divided between the two outlet pipes 30 and 32), will be a function of the control signals representative of the pressure variations into the carburetion or intake pipe 1.

For such a purpose into the valve 10 a diaphram 35 is arranged separating the inner chamber of said valve in two sub-chambers 31 and 47, into the sub-chamber 31 being mounted a compression spring 36 urging against the diaphram 35, to which the regulation shaped needle 38 is connected passing across the sub-chamber 47. Said spring 36 through said diaphram 35 tends to hold said needle 38 in such a position to at least partially shut the pipe 39. The sub-chamber 31 on the upstream side of the diaphram 35 communicates with the pipe 45 from which two pipes 2*a* and 2*b* are branched off, one of which ends on the upstream side of the throttle valve 6 into the throat of the inner Venturi tube, since in this embodiment a double Venturi tube system is provided into the intake pipe 1 comprising two coaxial Venturi tubes 7 and 8, while the other pipe 2*b* ends on the downstream side of the throttle valve 6.

The operation principle of the assembly 10 is the following: the effect of any vacuum variation sensed by means of the combination of the two pressure signals, one of which is taken through the pipe 2*a* the upstream side of the throttle valve 6 and, in particular in the restriction of the innermost Venturi tube 8, and the other taken through the pipe 2*b* which opens just on the downstream side of a throttle valve 6, is utilized through the pipe 45 in the main control valve 10 in order to produce a suction effect into the sub-chamber 31 on the upstream side of the diaphram 35. This effect will be algebraically added to the effect of the spring 36 and as results a displacement of the diaphram 35 and therefore of the needle 38 is obtained so as to cause a gauging of the control jet of fuel conveyed through the pipe 39. The load of the helical spring 36 may be adjusted by means of an adjusting screw 37 so as to vary the load resisting to the movement of the diaphram 35 caused in response to the aforesaid vacuum signal.

The needle 38 made integral with the diaphram 35 thus moves together with this latter letting pass a greater or lesser quantity of fuel fed through the pipe 39 as soon as the vacuum degree in the conduit 45 increases or decreases thus increasing or decreasing the delivery rate of the fuel issuing from the pipe 32. The screw 37 can be actuated during the adjusting step of the system, but this operation can also be advantageously carried out by remote-controlled means (not shown) mounted on the instrument panel by the driver during the engine running.

That permits to suit the operation of this system to particular temporary running conditions, as for instance, the requirement of a maximum engine power, of a minimum fuel comsumption and the like.

In the event wherein the starting of the engine takes place when the engine is yet cold, ans auxiliary control choke valve 18 is provided to control the intake air and which is mounted into the carburetion or intake conduit 1 on the upstream side of the double Venturi system of tubes 7 and 8.

In fact in the aforesaid starting conditions with cold engine said valve 18 is partially shut off so that as the engine attains a given revolution number, since the vacuum degree becomes higher within the pipes 2*a*, 2*b* and 45, a suction is created on the upstream side of the diaphram 35 of the valve 10, enabling to let issue a greater quantity of fuel from the pipe 39, thus producing an richer air-fuel mixture supplied into the engine cylinder.

The fuel issuing from the pipe 30 is conveyed into the auxiliary reservoir 14, from which the fuel may be recycled by means, for instance, of a pump 13 through the return pipe 62 which conveys a recycled fuel into the main reservoir 17. The fuel issuing from the pipe 32 in normal running condition or in acceleration conditions of the engine is fed into the carburetion pipe 1 through the pipes 34 and 33. The pipe 34 ends with a nozzle 3 which opens into the throat of the innermost Venturi tube 8, while the pipe 33 ends into the pipe 1 on the downstream side of the valve 6 and is controlled by the gauged valve 4 provided for supplying the fuel in the pipe 1 required for the slow running, valve which is provided with a gauging screw 5.

In the pipes 34 and 33 electro-valves 27 and 28 are provided which normally open and which are actuated through an electric circuit 52 energized by a battery (not shown) and controlled by a switch 26, actuated by a pneumatic subatmospheric pressure transducer 25 having an adjustable elastic load and which is responsive to any vaccum variation in the intake manifold 9, this latter communicating with said pneumatic tranducer 25 through the pipe 20.

Therefore during the phase when the engine is in motoring over condition, the valves 27 and 28 are shut and all the fuel issued from the fluidistor 29 passes into the recycle reservoir 14 through the pipe 30.

The closing of the two electric valves 27 and 28 during the engine operation in the motoring over condition takes place in the following manner. The subatmospheric pressure into the intake manifold 9 of the engine cylinder on the downstream side of the throttle valve 6 through the pipe 20, as soon as said vacuum condition increases beyond a predetermined limit causes the operation of the vacuum pneumatic tranducer 25 overcoming the resistence of the inner spring, and causes in turn the actuation of the switch 26 which controls the closing of the electric valves 27 and 28 during all the time of which there is such a running condition.

Of course, the operation of the vacuum senstive transducer may be so adjusted to take place only in the event that predetermined vacuum degrees are overcome in the intake manifold 9, i.e. only in the event that the engine is in motoring over condition, by duly adjusting the length of the work stroke of the pneumatic transducer 25. That has been provided in order to avoid to supply fuel into the engine during the motoring over condition.

The first of the two pipes 33 and 34 permits to supply the fuel required for the slow running condition of the engine, when the throttle valve 6 closes, and the second pipe serves to supply fuel into the engine cylinder in running conditions of middle and maximum speed and load. The distribution of the fuel between the pipes 33 and 34 is the result of a proper choice of the diameters of said pipes and of the position of the gauging needle 5, which is obtained by means of the adjusting screw 5 of the valve mounted in the end portion of the pipe 33. According to a "per se" well known solution, in the end portion of the pipe 33 is also provided with at least one passage or hole 55 in order to obtain a direct communication between said pipe 33 and the intake pipe 1 in order to allow the engine operation to gradually pass from the slow running condition to the running conditions in which middle and maximum supply of fuel is provided.

In the embodiment of FIG. 1 provision has been made that also during the acceleration phases an auxiliary fuel finelly atomized jet be injected automatically into the intake manifold 9 on the downstream side of the throttle valve 6 and which is supplied by an electro-injector 19 which is normally shut and which is fed through the pipe 15.

The electro-injector 19 is controlled by an electric circuit 57 connected to a battery (not shown) and in which a switch 56 is provided, which is actuated by an adjustable pressure transducer 58 into which pressurized air is conveyed through the pipe 16 in which a check valve 60 is provided and which ends into the chamber **23*a* of a double-acting pneumatic cylinder 23, into which is slidably received a piston 24, on which urges a spring 22, mounted in the opposite chamber 23*b*, said spring tending to move said piston 24 towards the orifice of the pipe 16 as well as of that of an air intake from the atomsphere and which is controlled by a check valve 21. The chamber 23*b* of the cylinder 23 communicates through the pipe 20*a* with the pipe 20 ending into the intake manifold 9, while the chamber 23*a* of said cylinder 23, through the pipe 16, in which the check valve 60 is provided, is put in communication with the pneumatic pressure transducer 58. From said pipe 16 and adjustable outlet valve 61 is branched off provided to allow to vary the discharge time period of the pneumatic cylinder 23 and therefore to vary the opening time of the injector 19. In slow and middle running and load conditions of the engine, when the throttle valve 6 is shut or is partially opened, or when, for other reasons, the subatmospheric pressure in the manifold 9 and therefore in the subchamber 23*b* of the cylinder 23 is sufficient to perform the return stroke of the piston 24 causing the compression of the spring 22, through the check valve 21 air is sucked into the subchamber 23*a*. As the acceleration phase of the engine begins and/or the throttle valve 6 is more or less quickly opened and/or the engine load varies, a corresponding quick increase of the pressure in the manifold 9 takes place and therefore in the pipes 20, 20*a* as well as in the chamber 23*b* of the cylinder 23. In consequence thereof, the piston 24 under the action of the spring 22 giving back elastic power which it had previously stored, moves and presses the air which had been previously sucked into the chamber 23*b*, causing said air to pass through the check valve 60 into the pipe 16 and to reach the pressure transducer 58, thus controlling the opening of the electro-injector 19.**

Figure 2:
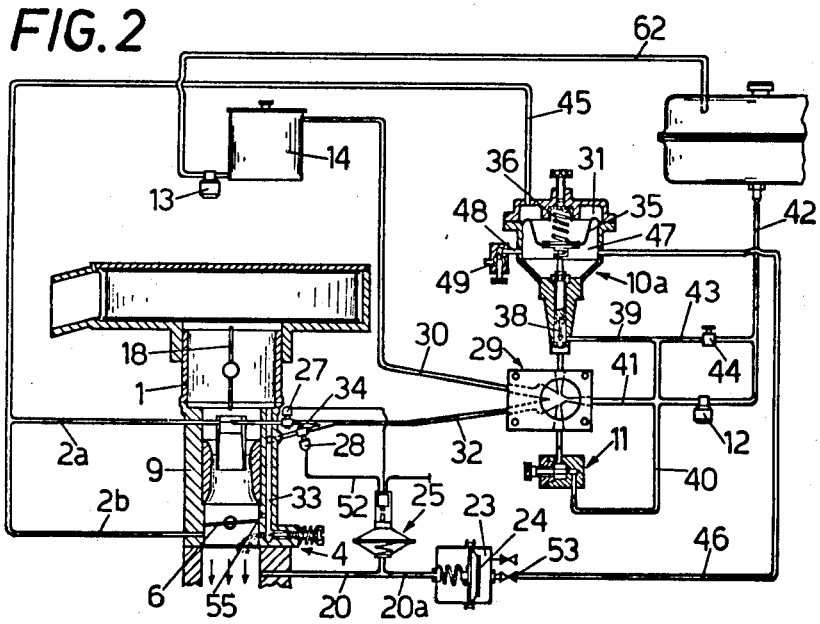
FIG. 2 is a similar view concerning a second embodiment.

In FIG. 2 another embodiment of the invention is shown which is substantially similar to the proceding one, so that similar parts are marked with the same numbers but with indices, while the parts that are exactly the same have the same numbers.

This variant aims to improve the engine characteristics during the acceleration phase, by varying the law according to which the delivery rate of the fuel is increased is increased which has to be supplied into the engine cylinder and which is conveyed through the pipe 39 to the fluidistor 29. In this variant said fuel increase is obtained not only in response of the increase of the suction effect in the chamber of the pressure sensitive diaphram **10*a* on the upstream side of said diaphram due to the subatmospheric pressure in the intake pipes 2*a* and 2*b* and in the pipe 45, but also under the effect of the double-acting pneumatic cylinder 23 operating as described with reference to the embodiment of FIG. 1. But in this second embodiment said cylinder 23 serves also for supplying pressurized air through the pipe 46, in which is arranged a check valve 53, into the chamber 47 of the valve 10*a* on the downstream side of the diaphram 35 during the acceleration transition condition, said air being then issued through the pipe 48 controlled by the needle gauged valve 49. By means of said valve 49 will be thus possible to control the air coming from the pneumatic cylinder 23 as well as to regulate the outlet time interval during which a greater quantity of fuel comes out of the pipe 39 and therefore out of the pipe 32** through which the fuel is fed.

As long as an air flow arrives into chamber 47 the diaphram 35 is subjected to a pressure which at first increases and then decreases during the transition period according to the law of the air discharge from the pneumatic cylinder 23. During said transition periods therefore on the diaphram 35 of the valve **10*a* a resultant force acts which causes the movement of the control needle 38 in the opening direction so that a higher delivery rate of the control jet through the pipe 39** into the fluidistor is obtained and as a result thereof a higher fuel delivery rate into the engine cylinder is also obtained.

As the piston 24 of the pneumatic cylinder 23 attains the end of its working stroke, through the discharge valve 49 the ambient pressure re-established into the chamber 47 of the servo-valve 10*a*, so that the diaphram 35 under the action of the spring 36 returns into a condition which depends on the new running conditions.

In the two embodiments shown in FIGS. 1 and 2 provision has been made to use for the control of the delivery rate of the fuel supplied through the fluidistor 29, a single engine parameter, i.e. substantially the vacuum variation into the intake manifold on the upstream side of the throttle valve.

Figure 3:
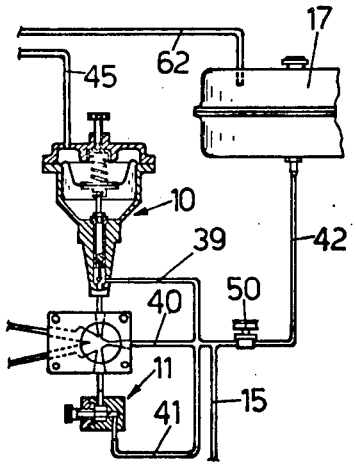
FIGS. 3 to 5 show variants of the first embodiment and concern modifications of the fuel supply system.
Figure 4:
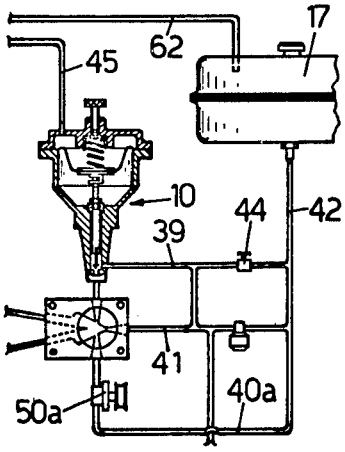
Figure 5:
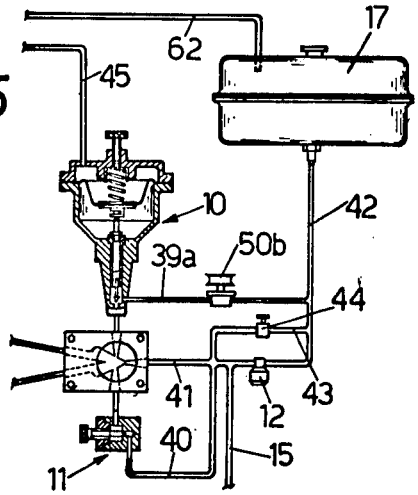

A more approximate solution of the problem of affording the optimal regulation of an internal-combustion engine can be obtained by using at least another engine parameter, as, for instance, besides the aforementioned vacuum degree in the intake pipe, the engine revolving speed. On the other hand, taking in consideration that the fluidistor has 3° of freedom of regulation, due to the three possible cross-section areas of the intake pipes i.e. the pipe 41 and two control pipes 39 and 40, that permits the introduction of a further information. In the detail of the variant, shown in FIG. 3, the main electro-pump 12, provided in the embodiment of FIG. 1, is now sutstituted by the volumetric pump 50 directly or indirectly actuated by the driving shaft of the engine; the by-pass pipe 43 and the limiting device 44 are omitted. In the variant, shown in FIG. 4, the flow diagram is identical to that of FIG. 1, but a volumetric pump 50*a* is provided in the pipe 40*a* branched off on the upstream side of the electro-pump 12 so as to allow to supply into the fluidistor 29 through the pipe 40*a* fuel jet, the delivery rate of which varies proportionally to the engine revolving speed. In such a manner the control jet 40*a* acts in any event as a means for controlling the jet issuing from the pipe 39. In FIG. 5 is shown a feeding flow diagram always based on that of FIG. 1, but where the fuel stream passing through the pipe 39*a* and supplied into the servo-valve 10 is already proportional to the engine revolving speed, since this pipe is branched off from the pipe 42 on the upstream side of the electro-pump 12 and in this latter pipe a volumetric pump 50*b* is provided operating in response to the speed variations of the driving shaft of the engine.

It will be apparent that while it has been shown and described the invention in several preferred forms, changes may be made in the structure, and the devices provided therein may be substituted by other equivalent devices, without departing from the scope of the invention as sought to be defined in the following claims.

What I claim is:

1. An air-fuel ratio control system operating in response to the running conditions of an internal-combustion engine, having an intake pipe, with controlled ignition and fed by a liquid fuel, continuously supplied through a main pump from a main fuel source and which liquid fuel, during operation, is at least partially deviated into a recycle circuit connected to the main fuel source and, as the throttle valve controlling the intake pipe is at least partially opened, is injected into the intake pipe into which the carburation air is drawn from the atmosphere under the control of a manually operable shut-off valve, said air-fuel ratio control system comprising in combination, a supply pipe supplying the fuel from said main fuel source through said main pump; a fluidistor having an inner chamber; at least three branch pipes branching from said supply pipe and communicating with said inner chamber; a first branch pipe supplying a jet of fuel at a constant delivery rate, a second branch pipe supplying a jet of fuel at a constant but adjustable delivery rate, and a third branch pipe supplying a jet of fuel at a variable delivery rate; a pressure sensitive diaphram valve controlling the delivery rate of said third branch pipe in response to the resultant value of the sub-atmospheric pressure in said intake pipe as sensed on the upstream and downstream sides of said throttle valve; said fluidistor chamber having two outlet orifices each having a respective predetermined cross-section; a recycle reservoir forming part of said recycle circuit; a first outlet pipe connecting one outlet orifice to said recycle reservoir; a second outlet pipe connected to the other outlet orifice and divided into two branches, the first of which terminates in a fuel injection nozzle positioned on the upstream side of said throttle valve and the second of which terminates in an adjustable injection nozzle supplying into the intake pipe the fuel required for slow running of the engine, the adjustable injection nozzle being arranged on the downstream side of said throttle valve; respective normally open electric valves controlling each of the branches from said second outlet pipe; a pressure transducer connected to said electric valves and operable to shut said electric valves responsive to the degree of vacuum in the interior of the fuel intake manifold, on the downstream side of the throttle valve, to close said electric valves, said pressure transducer operating to close said electric valves only when the degree of vacuum in the manifold is below a predetermined minimum value; and means operable to adjust said pressure sensitive diaphram valve and effective also during operation of the engine.

2. A system according to claim 1, in which said main pump is an electric pump mounted in said supply pipe upstream of the point where said branch pipes are connected to said supply pipe; a by-pass pipe connected in parallel with said main pump; and an adjustable pressure limiting device connected in said by-pass pipe.

3. A system according to claim 1, in which said pressure sensitive diaphram valve is formed with a valve chamber and a diaphram member in said valve chamber separating said valve chamber into first and second subchamber; an adjustable compression spring in said first chamber biasing the diaphram outwardly thereof; said third branch pipe having an outlet orifice opening into said pressure sensitive diaphram valve and normally communicating with said fluidistor; a shaped needle secured to siad diaphram and controlling flow through said outlet orifice between a position fully closing said outlet orifice and a position fully opening said outlet orifice; said shaped needle extending across said second sub-chamber; pipe means establishing communication between said first sub-chamber and said air intake pipe both on the upstream side of said throttle valve and on the downstream side of said throttle valve; and remote control means operable to adjust the loading of said compression spring.

4. A system according to claim 1, including a fourth branch pipe communicating with said fuel supply pipe on the downstream side of said main pump; an electrically controlled injector communicating with said intake manifold; a pressure transducer controlling said injector; a double-acting type pneumatic piston-cylinder actuator; means, including a check valve, connecting said actuator to said pressure transducer; means connecting one side of the piston of said actuator to said intake manifold on the downstream side of said throttle valve; the piston of said actuator, in one operative stroke toward said intake manifold, aspirating atmospheric air through said check valve; said piston having a return stroke in the opposite direction responsive to any decrease of the pressure in said intake manifold on the downstream side of said throttle valve; and adjustable spring in said actuator biasing said piston against movement in the direction of its return stroke; said pressure transducer being connected to said actuator by a pipe; and a adjustable exhaust valve interposed in said last-named pipe.

5. A system according to claim 1, including a double-acting piston-cylinder pneumatic actuator; a check valve connected to said acutator; a pipe connected to said actuator; said actuator being operable to aspirate atmospheric air through said check valve and to force air into said last-named pipe; said actuator having a chamber communicating with said intake pipe; a spring in said chamber biasing the piston of said actuator in a direction to counteract the suction effect due to sub-atmospheric pressure in said intake manifold and to effect the return stroke of said piston and aspiration of air into said actuator; said pressure responsive diaphram valve including a diaphram having a downstream side and an upstream side; and a check valve connecting said last-named pipe with said pressure responsive diaphram valve on the downstream side of said diaphram; said actuator, as the valve of the sub-atmospheric pressure in said intake pipe decreases, forcing air into said last-named pipe through said check valve to said pressure responsive diaphram valve to cooperate in controlling the opening of said pressure responsive diaphram valve at the beginning of each acceleration transition period.

6. A system according to claim 1, in which said main fuel supply pump is a volumetric pump operating responsive to the angular velocity of the driving shaft of the engine; said volumetric pump being mounted in said fuel supply pipe on the upstream side of the point at which said branch pipes are connected to said supply pipe.

7. A system according to claim 1, in which said main pump is an electric pump connected on the upstream side of said first and second branch pipes supplying fuel to said fluidistor; an adjusting valve connected in said third pipe; and a volumetric pump, actuated by the driving shaft of the engine, conveying fuel to said adjusting valve.

8. A system according to claim 1, in which said main pump is an electric pump connected on the upstream side of said first and second branch pipes connected to said fluidistor; said third branch pipe communicating with said supply pipe upstream of said pump; and a volumetric pump, actuated by the driving shaft of the engine, connected in said third branch pipe.

* * * * *